US007994720B2

(12) United States Patent
Corazza et al.

(10) Patent No.: US 7,994,720 B2
(45) Date of Patent: Aug. 9, 2011

(54) HIGH PRESSURE DISCHARGE LAMP CONTAINING A GETTER DEVICE

(75) Inventors: Alessio Corazza, Como (IT); Werner Jehr, Cologne (DE); Massimo Palladino, Lainate (IT)

(73) Assignee: Saes Getters S.p.A., Lainate MI (IT)

( * ) Notice: Subject to any disclaimer, the term of this patent is extended or adjusted under 35 U.S.C. 154(b) by 788 days.

(21) Appl. No.: 11/816,935

(22) PCT Filed: Feb. 20, 2006

(86) PCT No.: PCT/IT2006/000088

§ 371 (c)(1),
(2), (4) Date: Aug. 23, 2007

(87) PCT Pub. No.: WO2006/090423

PCT Pub. Date: Aug. 31, 2006

(65) Prior Publication Data

US 2008/0169759 A1 Jul. 17, 2008

(30) Foreign Application Priority Data

Feb. 23, 2005 (IT) ..... MI2005A0281

(51) Int. Cl.
*H01J 17/18* (2006.01)

(52) U.S. Cl. ..... 313/623; 313/634

(58) Field of Classification Search ..... 313/623–643
See application file for complete search history.

(56) References Cited

U.S. PATENT DOCUMENTS

| | | | |
|---|---|---|---|
| 3,203,901 | A | 8/1965 | Porta |
| 4,306,887 | A | 12/1981 | Barosi et al. |
| 5,882,727 | A | 3/1999 | Corazza et al. |
| 5,908,579 | A | 6/1999 | Comte et al. |
| 5,961,750 | A | 10/1999 | Boffito et al. |
| 2001/0003411 | A1 | 6/2001 | Honda et al. |
| 2003/0007883 | A1 | 1/2003 | Toia et al. |

FOREIGN PATENT DOCUMENTS

| | | | |
|---|---|---|---|
| GB | 1248184 | A | 9/1971 |
| GB | 2154055 | A | 8/1985 |
| JP | 54071886 | A | 6/1979 |
| JP | 63218147 | A | 9/1988 |
| JP | 04233153 | A | 8/1992 |
| JP | 2000317247 | A | 3/2001 |
| JP | 2001283772 | A | 10/2001 |
| WO | 2004/107390 | A1 | 12/1994 |
| WO | 98/53479 | A1 | 11/1998 |
| WO | 01/67479 | A1 | 9/2001 |
| WO | 02/089174 | A2 | 11/2002 |
| WO | 03/029502 | A2 | 4/2003 |
| WO | 2006/057020 | A1 | 6/2006 |

*Primary Examiner* — Anne Hines

(74) *Attorney, Agent, or Firm* — Panitch Schwarze Belisario & Nadel LLP

(57) ABSTRACT

A miniaturized high pressure discharge lamp containing a getter device is provided in which the getter device is positioned in such a way as to minimize or completely suppress the shadow effect with respect to the light emitted by the lamp burner.

5 Claims, 9 Drawing Sheets

Prior Art

HIGH PRESSURE DISCHARGE LAMP CONTAINING A GETTER DEVICE

CROSS-REFERENCE TO RELATED APPLICATIONS

This application is a Section 371 of International Application No. PCT/IT2006/000088, filed Feb. 20, 2006, which was published in the English language on Aug. 31, 2006, under International Publication No. 2006/090423 A1, the disclosure of which is incorporated herein by reference.

BACKGROUND OF THE INVENTION

The present invention relates to a high pressure discharge lamp, particularly of small dimensions, containing a getter device.

High pressure discharge lamps (also known as high intensity discharge lamps) are lamps in which the light emission is due to the electric discharge that is established in a gaseous medium comprising a noble gas (generally argon, with the possible addition of minor amounts of other noble gases), and vapors of different metals according to the kind of lamp.

These lamps are classified according to the means in which the discharge takes place. A first type are the sodium high pressure lamps, wherein the discharge means is a mixture of sodium and mercury vapors (obtained through vaporization of an amalgam of the two metals) and wherein, in operation, the vapors can reach pressures of about 105 Pascal (Pa) and temperatures higher than 800° C.; a second type are the mercury high pressure lamps (discharge in mercury vapors) wherein the vapors can reach pressures of about 106 Pa and temperatures of about 600-700° C.; finally, a third type of high pressure discharge lamps are metal halides lamps, wherein the discharge means is a plasma of atoms and/or ions created by the dissociation of sodium, thallium, indium, scandium or Rare Earths iodides (generally, each lamp contains at least two or more of these iodides), in addition to mercury vapors; in this case, with a lamp being turned on, pressures of 105 Pa can be reached in the burner and temperatures of about 700° C. in the coolest point of the lamp.

In FIG. 1 a generic high pressure discharge lamp, of the type wherein the electric connectors are on one side only of the lamp, is shown in a sectional view. Although in the rest of the description reference is always made to this type of lamp, the invention can be also applied in the so-called "double-ended lamps", wherein there are electric contacts on both ends of the lamp. The lamp L is formed of an external bulb C, generally made of glass, inside which the so-called burner B is provided, formed of a generally spherical or cylindrical container of quartz or translucent alumina. Two electrodes E are present at two burner ends, and a noble gas added with a metal or a metal compound in vapor form (or vaporizable with the lamp turned on) V is provided inside thereof, the mixture of noble gas and the vapor being the means in which the discharge occurs. As known in the field, an end A of the bulb, and two ends Z of the burner are sealed by heat compression. The burner is kept in place by two supporting metal parts M, through metal feedthroughs R, these latter being fixed in parts Z by heat compression sealing these latter around the feedthroughs. The combination of the two parts M and R has also the function of electrically connecting the electrodes E to the contacts P external to the lamp. The space S enclosed in the bulb can be evacuated or filled with inert gases (normally nitrogen, argon or mixtures thereof). The bulb has the purpose of mechanically protecting the burner, thermally insulating this from the outside and, above all, keeping an optimal chemical environment outside the burner. Despite the provision of a particular atmosphere in the bulb, traces of impurities are always present in the lamp, for instance as a consequence of the manufacturing operations of the lamps, coming from outgassing or decomposition of components of the lamps or due to permeation from the external atmosphere. These impurities need to be removed, as they can alter the optimal lamp operation according to various mechanisms. Oxidizing gases possibly present outside the burner, due to the temperatures reached in the vicinity thereof, could damage the metal parts being present (parts M or R). Hydrogen, if present in the bulb, can easily permeate through the burner walls at the operating temperatures of these lamps, and once in the burner it has the effect of enhancing the potential difference between the electrodes E required for establishing and maintaining the discharge, thereby increasing the lamp power consumption. In addition, this rise of potential difference causes a rise in the electrodes "sputtering" phenomenon, consisting in the erosion thereof due to the impact of the ions present in the discharge, with consequent formation of dark metallic deposits on the burner internal walls and decrease of the lamp brightness. For these reasons, hydrogen is commonly considered the most noxious impurity in lamp bulbs.

To remove these impurities, it is known to insert in the bulb, outside the burner, a getter material capable of chemically fixing them. The getter materials are generally metals like titanium, zirconium, or alloys thereof with one or more transition elements, aluminum or Rare-Earths. Getter materials suitable for the use in lamps are described, for example, in U.S. Pat. Nos. 3,203,901 (zirconium-aluminum alloys); 4,306,887 (zirconium-iron alloys); and 5,961,750 (zirconium-cobalt-Rare Earths alloys). For the sorption of hydrogen, particularly at high temperatures, the use of yttrium or alloys thereof is also known, as described, for example, in British Patent GB 1,248,184 and in the International patent application publication WO 03/029502. Getter materials can be inserted in the lamps in the form of devices formed of the material only (for example, a sintered getter powder pellet), but more commonly these devices comprise a support or metallic container for the material. In FIG. 1 is shown a getter device C, typically used in lamps, formed of a thin metal plate on which a pellet of getter material powder is fixed. The drawing also shows a very common way of getter assembly to the internal structure of the lamp, in the so-called "flag" position. An example of a lamp containing a getter in the bulb is disclosed in International patent application publication WO 02/089174.

However, the known mountings of getter devices inside lamp bulbs have the drawback of causing a "shadow" effect, shielding the light coming from the burner for a solid angle depending on dimension of the getter device, its closeness to the burner, and its orientation with respect to the burner. This effect is undesired by lamp manufacturers, as it reduces by some percent units the overall lamp brightness. The shadow effect is a felt problem with conventional high pressure discharge lamps, which have relatively large dimensions (the bulb generally has a length greater than 10 cm). It becomes much worse in high pressure discharge lamps of recent development which have sensibly reduced dimensions, for example with bulbs having an external diameter of about 2 cm or less and length of less than 7 cm (in the remaining part of the text, high pressure discharge lamps with these dimensions will be referred to as miniaturized lamps). With such reduced dimensions, positioning the getter device inside the bulb presents a number of problems. In the first place, there is a direct effect: a bulb of reduced dimensions forces positioning the getter device closer to the burner compared to larger dimension lamps, so that, with the same dimensions of the getter device, the shadow effect is increased. In the second place, there is an indirect effect linked to the fact that the sorption of hydrogen by getter materials is (contrary to all other common impurities) an equilibrium phenomenon: the higher the temperature, the higher the pressure of gaseous hydrogen in equilibrium with the getter. With miniaturized lamps, any bulb location is at relatively high temperature and as a consequence, in order to guarantee sufficiently low pressures of gaseous hydrogen in the bulb, it would be necessary to increase the amount of getter material and thus the dimensions of the getter device. This increase in dimensions and the above mentioned need to place the device close to the burner concur to increase the shadow projected by the getter device.

BRIEF SUMMARY OF THE INVENTION

An object of the present invention is to provide high pressure discharge lamps, and particularly miniaturized ones, which solve the above mentioned problems.

According to the present invention, this object is achieved with a high pressure discharge lamp containing a getter device, characterized in that the getter device is:

- filiform, fixed to one of the metal parts supporting the burner, and in such a position to be parallel to the metal part and essentially hidden to the burner by the metal part; or
- attached to at least one feedthrough for the electrical feeding of the burner; or
- in the form of a hollow filiform body filled with getter material, which forms fully or in part the burner supporting metal part, extending itself between the two heads of the lamp.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 2:
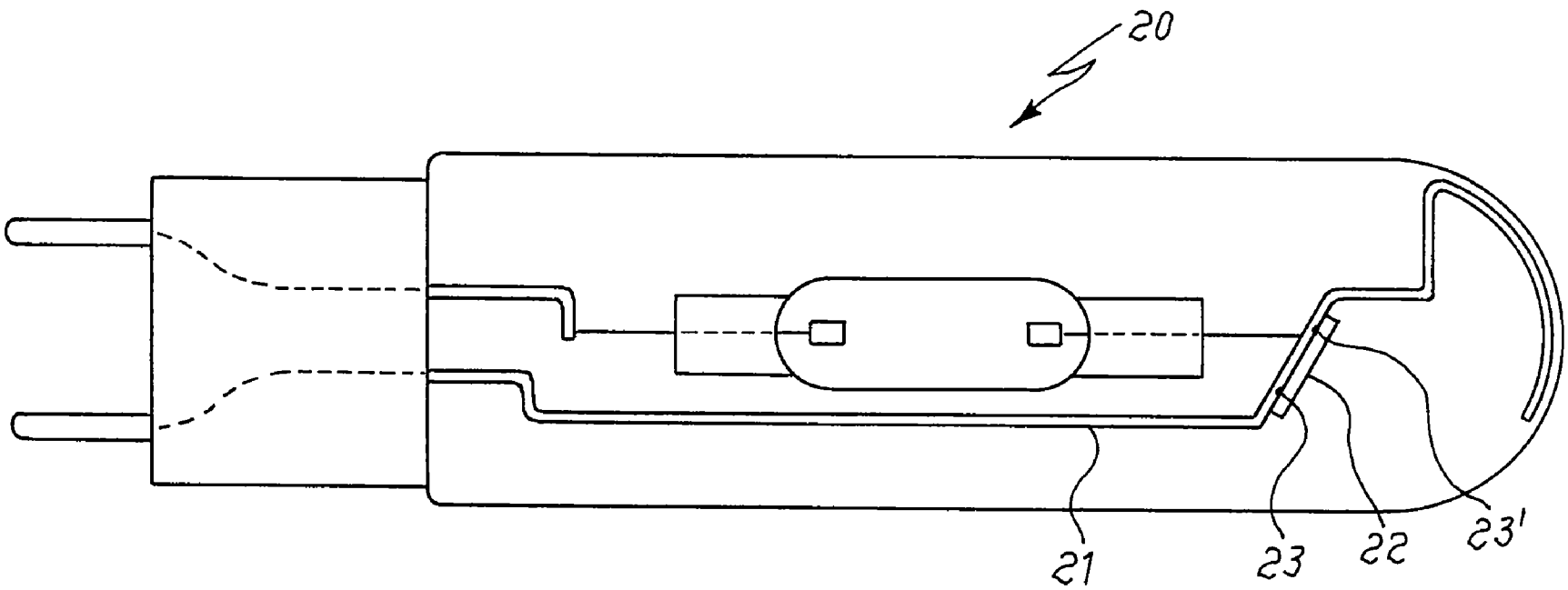
FIG. 2 is a cross-sectional view of a first embodiment of a lamp according to the present invention.
Figure 3:
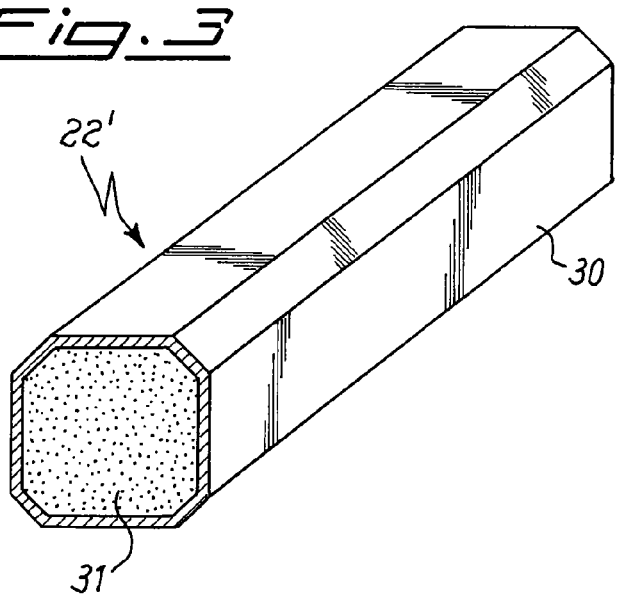
FIGS. 3 and 4 are representations of two possible getter devices to be used in the lamp of FIG. 2.
Figure 4:
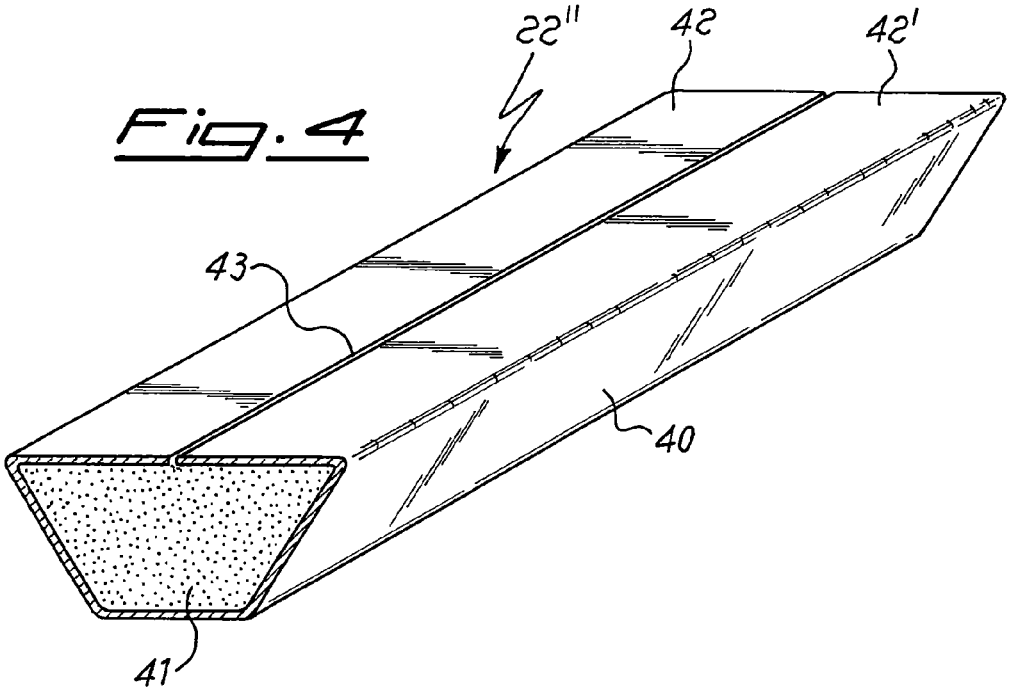

A first embodiment of a lamp of the invention is illustrated in FIG. 2, also with reference to FIGS. 3 and 4. The lamp 20 comprises a supporting metal part 21 on which a filiform getter device 22 is fixed. Device 22 is of a width similar to, and preferably not greater than, the cross-section of part 21, and is fixed on this part (for example, by two welding points 23 and 23') in such a way that, when viewed along the lamp axis, its projection is essentially fully included in the supporting part 21 on which it is fixed. With this assembly the getter device 22 results "hidden" to the burner and does not increase the shadow effect due to part 21, which is unavoidable.

Getter devices suitable for the use in the lamp of FIG. 2 are shown in FIGS. 3 and 4.

Device 22' (FIG. 3) is formed of a generally metallic housing 30 extended and open at the ends. Inside housing 30 a getter material 31 is present in powder form. The device shown in the drawing has a false-square cross-section, but obviously other sections are also possible, such as circular, square or rectangular. The device of FIG. 3 can be obtained by passing a tube of a greater cross-section area filled with getter powder through a series of compression rollers, according to the process described in the International patent application publication WO 01/67479 of SAES Getters S.p.A. (even though this application refers to the production of mercury dispensers). With this process devices of the type 22' with a width of about 0.8 mm have been produced, and it is possible to further reduce these dimensions to at least about 0.6 mm.

Device 22" (FIG. 4) is formed of a generally metallic housing 40, containing getter material powder 41. The housing 40 is formed of a shaped thin metal plate, thus obtaining an essentially closed cross-section (a trapezoidal cross-section is shown in the drawing). Between the two edges 42 and 42' of the thin plate forming the housing a slit 43 is left, which provides a further path for the access of gases towards the getter material 41 (in addition to the openings at the ends of the device). This device can be manufactured by the process described in International patent application publication WO 98/53479 (in this case too the application refers to the production of mercury dispensers, but the process can be used for the production of getter devices in the same way). With this process devices have been obtained with such a cross-section that the trapezium largest side is about 0.75 mm long and the height is about 0.6 mm.

The housing of devices 22' and 22" is generally made of nickel, nickel-plated iron, stainless steel. It is also possible to use niobium or tantalum which, although more expensive, have the advantage of being less susceptible to vaporization with respect to the above mentioned materials, and can thereby be more freely positioned inside the lamp, even in positions closer to the burner, without the risk of dark deposit formation on the lamp walls due to metallic vapor condensation thereon. Niobium and tantalum also have the advantage of being easily permeable to hydrogen, especially at high temperatures, so that in this case the sorption of this gas by the getter material takes place not only at the ends of the device and possibly through the slit 43, but rather through the whole surface of the device.

The lamp according to the second embodiment of the invention has the getter device attached to at least one and preferably both feedthroughs for the electrical feeding of the burner. The use of two getter devices, one on each feedthrough, has the advantage of doubling the amount of available getter material, but in some cases one single device may be used for economical reasons.

Figure 5:
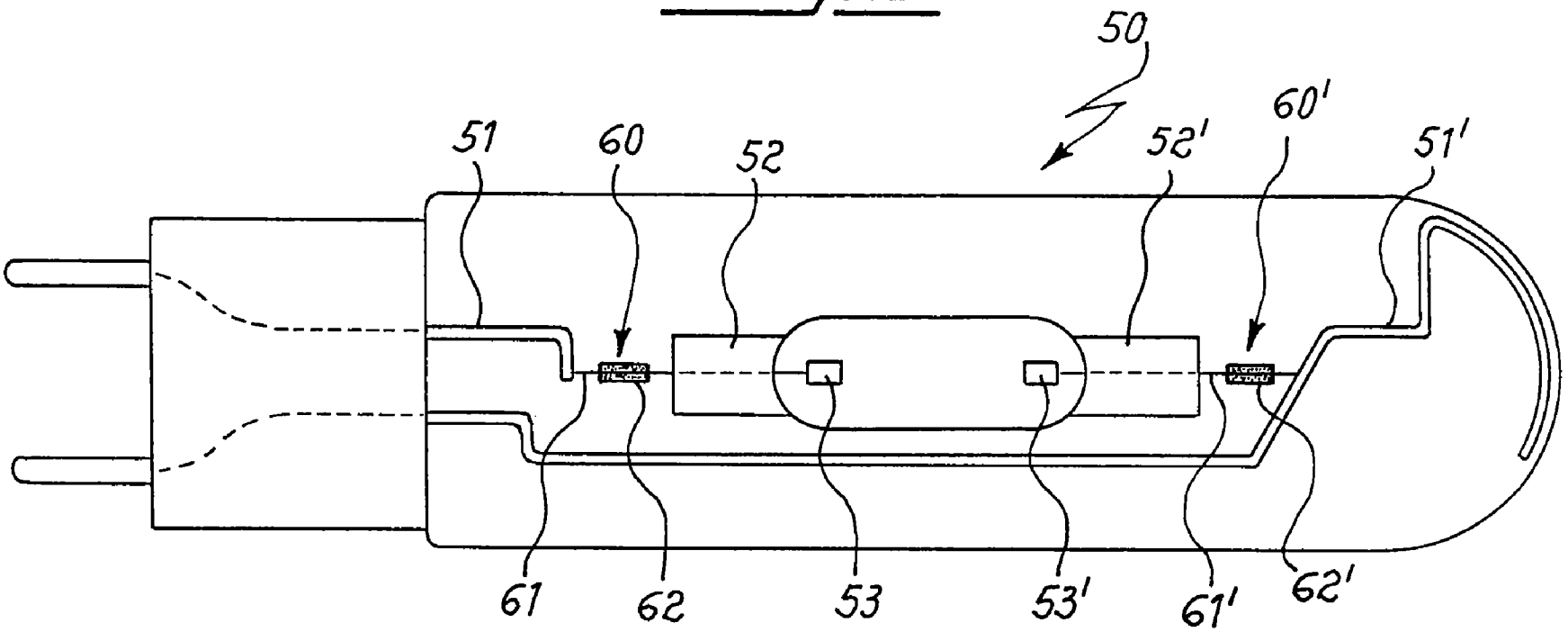
FIG. 5 is a cross-sectional view of a second embodiment of a lamp according to the present invention.
Figure 8:
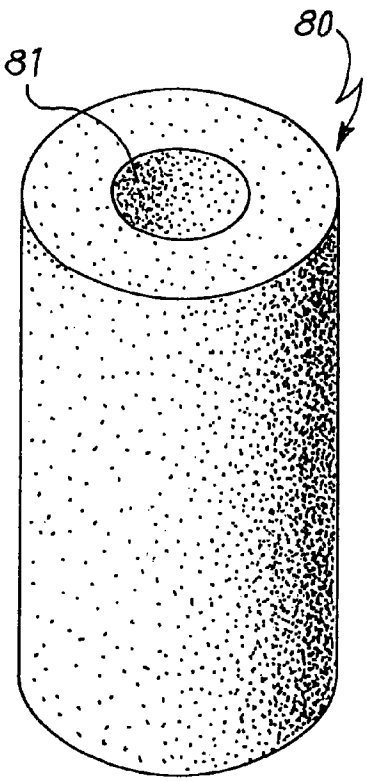
FIG. 8 is a representation of a getter device to be used in a lamp of FIG. 7.
Figure 6:
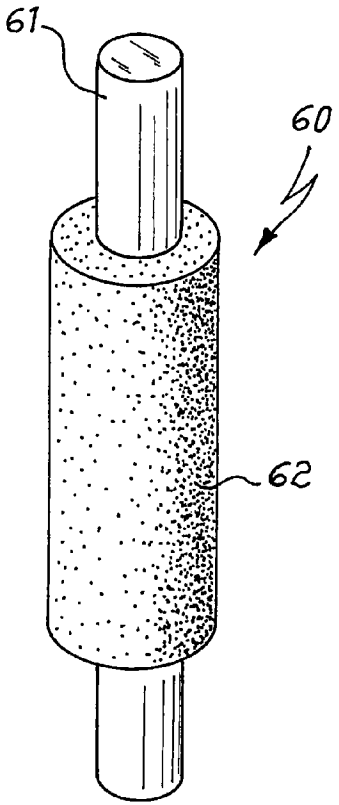
FIG. 6 is a representation of a getter device to be used in a lamp of FIG. 5.
Figure 7:
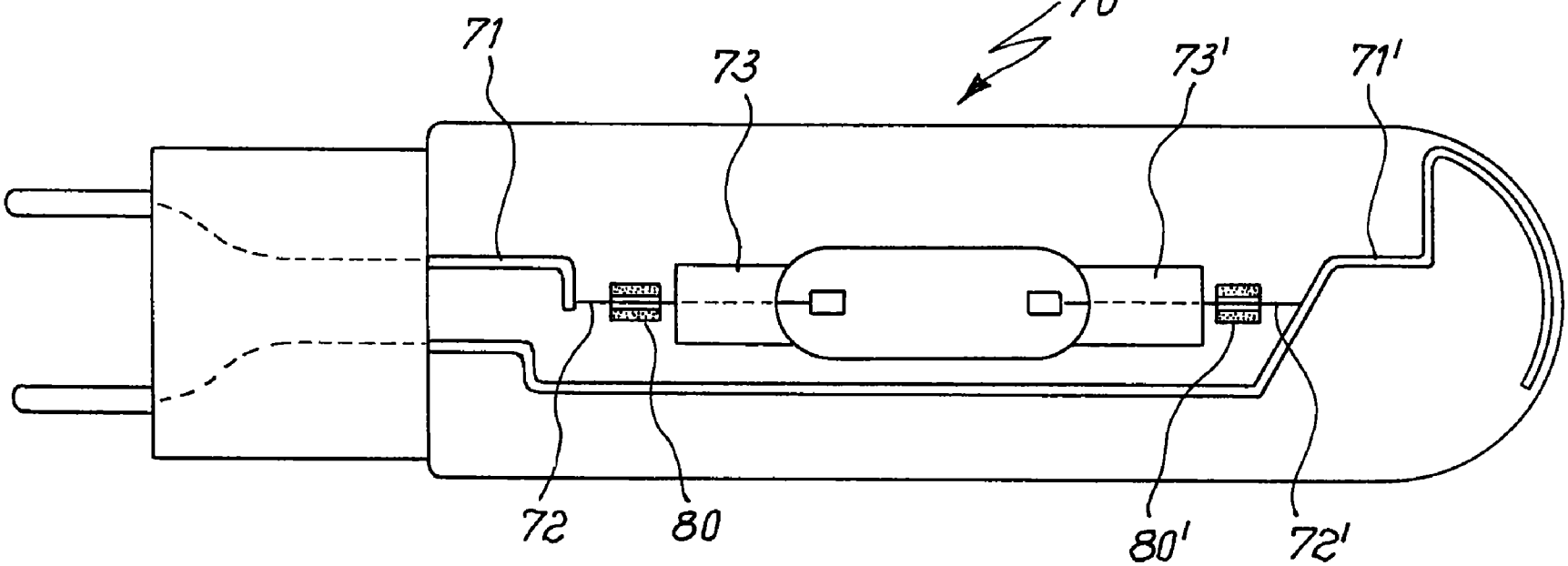
FIG. 7 is a cross-sectional view of another embodiment of a lamp according to the present invention.

This embodiment can be realized in two alternative ways, the first of which is illustrated in FIGS. 5 and 6, while the second is illustrated in FIGS. 7 and 8.

The lamp 50 according to this first alternative is shown in FIG. 5. Lamp 50 comprises a first supporting part 51 that, through feedthrough 60 sealed in burner terminal 52, electrically feeds electrode 53; and a second supporting part 51' that, through feedthrough 60' sealed in the opposite burner terminal 52', electrically feeds electrode 53'. The structure of feedthrough 60 (the same as 60') is illustrated in detail in FIG. 6, and comprises a metallic wire 61 onto which is formed a body of getter material forming getter device 62. Feedthrough 60 with getter device 62 can be produced for example through the metal injection molding technique, well known in the field of powder metallurgy, by positioning wire 61 in the mold in which the powder of getter material is poured, compressing the powder and then heating the assembly of powder-wire to a temperature suitable to consolidate the structure. Alternatively, device 62 may be produced by depositing (e.g., by dispensing with a brush) a suspension of particles of getter material onto wire 61, heating the assembly to a first temperature to cause evaporation of the liquid phase of the suspension, and then heating the resulting assembly to a second, higher temperature, to cause consolidation by sintering of the getter particles deposit. The suspension may be prepared with a powder of getter material with particle size smaller than about 150 μm in a dispersing medium having an aqueous, alcoholic or hydroalcoholic base and containing less than 1% by weight of organic compounds having a boiling temperature higher than 250° C., with a ratio between the weight of getter material and the weight of dispersing medium between 4:1 and 1:1, as described in U.S. Pat. No. 5,882,727 of SAES Getters S.p.A.

A getter device 62 formed directly onto wire 61 is rather easy to produce, but may suffer the problem that the repeated thermal cycling consequent to turning the lamp on and off could cause breaks and eventually detachment, at least partially, of the getter body from the wire. This drawback can be avoided by choosing a material for getter device 62 having characteristics of thermal dilation similar to those of the material of wire 61.

This problem may be avoided by using the second alternative way of attaching the getter device to the feedthroughs, as illustrated in the lamp of FIG. 7. This lamp 70 has supports 71 and 71', supporting feedthroughs 72 and 72' compression sealed in burner ends 73 and 73' for the electrical feeding of the electrodes in the burner. The getter device 80 (the same as 80') is shown enlarged in FIG. 8, and has the form of a hollow cylinder with a central hole 81 having a diameter slightly greater than that of the wire of the feedthroughs. This device can be obtained for example through the metal injection molding technique previously cited, or through the process described in U.S. Pat. No. 5,908,579 of SAES Getters S.p.A. A device of type 80 can be mounted in lamp 70 by simply inserting a feedthrough 72 (or 72') in hole 81, before welding the feedthrough to one of the supporting parts 71 and 71', or before the heat compression sealing of burner terminals 73 and 73' around the feedthroughs. The fact that diameter of hole 81 is greater than that of feedthrough 72 allows these two parts to expand or shrink independently from each other, each one according to its own thermal dilation characteristics, thus avoiding the risk of breaking body 80.

Both devices 62 and 80 allow having in the lamp the necessary amount of getter material, but with a reduced external diameter, such that the getter device projection is essentially included in the width of parts 52, 52' or 73, 73', which are generally poorly transparent (especially in the common case of a burner made of alumina), thereby substantially not causing additional shadow effect.

Figure 10:
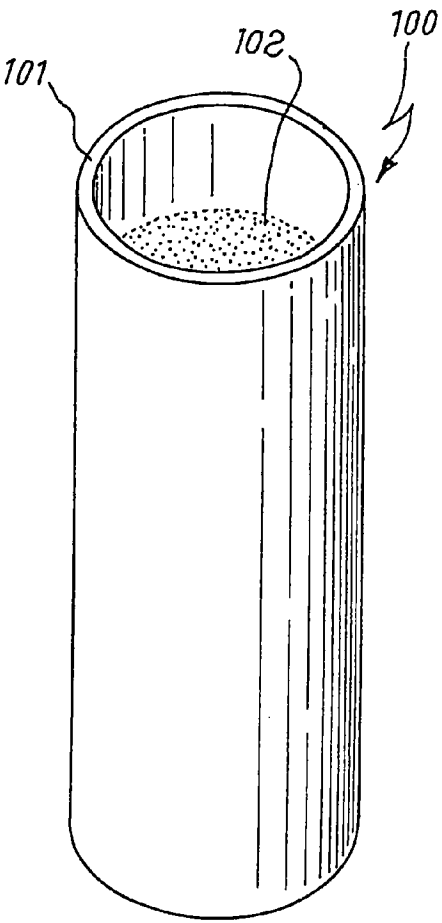
FIG. 10 is a representation of a getter device for use in a lamp of FIG. 9.
Figure 9:
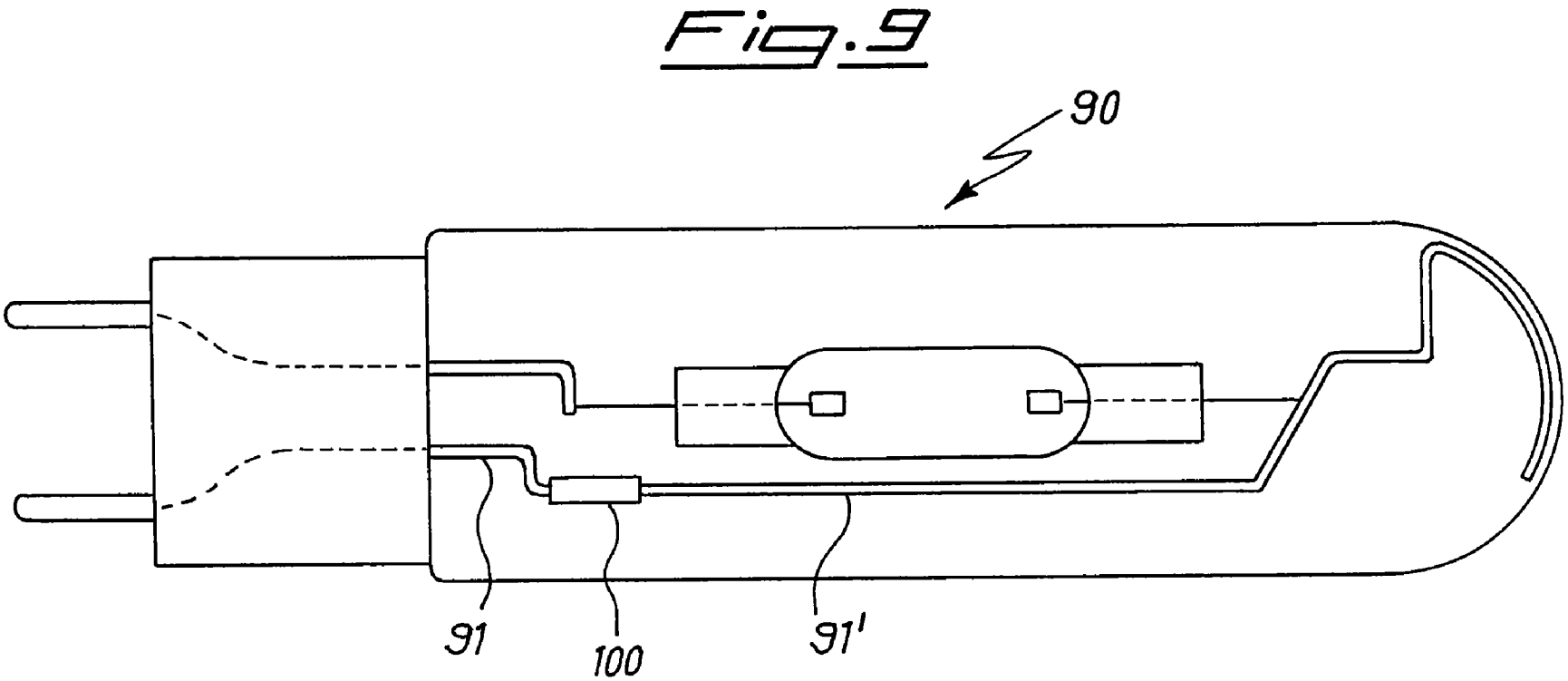
FIG. 9 is a cross-sectional view of another embodiment of lamp according to the present invention.

FIG. 9 shows another embodiment of the lamp of the invention. Lamp 90 has the main support formed of two parts 91 and 91', linked to each other by the getter device 100. Device 100 is shown enlarged in FIG. 10, and it is formed of a tubular housing 101 internally filled with getter material 102, except for the ends. Housing 101 is made of a material which exhibits a good hydrogen permeability at high temperature, niobium for example, so that the gas can pass through the housing and reach the getter material, where it is chemically fixed. The hydrogen permeation through the housing can be maximized by minimizing the housing thickness, compatibly with the mechanical resistance needs of the assembly. The minimum possible thickness can be easily identified with a limited number of experimental tests. The two ends of device 100 are not filled with getter material, thus forming two seats for the insertion of the ends of parts 91 and 91' of the burner support. The fixing between device 100 and parts 91 and 91' is preferably reinforced through welding. A device of type 100 can be produced, for example, by providing a section of a niobium tube of the same diameter as the final getter device, holding this tube in vertical position by inserting in its bottom aperture a support of the same diameter as the internal diameter of the tube itself and of a height equal to the part not to be filled with getter material at a first end of the completed device. By pouring getter material powder into the container formed by the housing and its lower support and by pressing the powder in the so-formed container by a piston of a diameter equal to the inner diameter of the housing, the amount of getter material will be optimized to be such that, after compression, it leaves at the second end of device 100 a second part free from the getter material itself. To avoid housing deformations due to the powder compression, it is also possible that the housing is contained in an external mold during this operation. With this embodiment, the shadow effect due to the getter device is minimum, and practically negligible with respect to the effect caused by the support, which is unavoidable.

Figure 11:
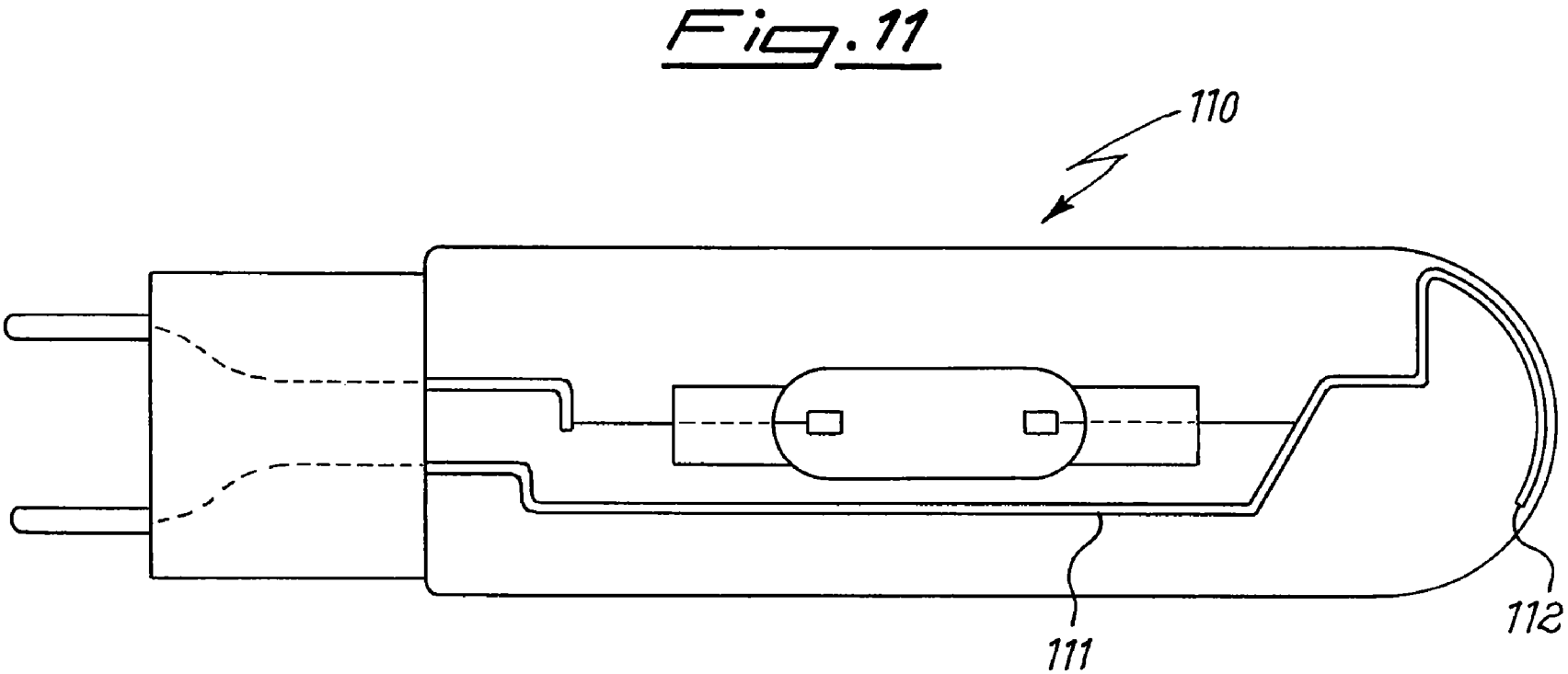
FIG. 11 is a cross-sectional view of a further embodiment of lamp according to the present invention.

Another possible embodiment of lamp of the invention is shown in FIG. 11. In this lamp 110 the getter device 111 also performs the function of support for the burner. This getter device may be similar to the one of FIG. 3, 4 or 10, with the difference that in this case the whole length of the longer support of the burner is formed of a housing filled with getter material. Such type of getter device can be manufactured with the techniques described in the above mentioned International patent application publications WO 98/53479 and WO 01/67479. In the case of a getter device produced as described in WO 01/67479, the housing material will be made of a material which exhibits a good permeability to hydrogen, e.g. niobium. The end 112 of device 111 is open anyway, and represents an additional hydrogen direct access channel to the getter material. In the case of a getter device produced as described in WO 98/53479, it may be produced with a material of high hydrogen permeability as well, but this is not a strict requirement in this case, because the slit 43 along the whole length of the device already assures a satisfactory rate of access of hydrogen molecules to the getter material. In this second case, a wider choice of materials for the housing material is thus allowed.

Figure 1:
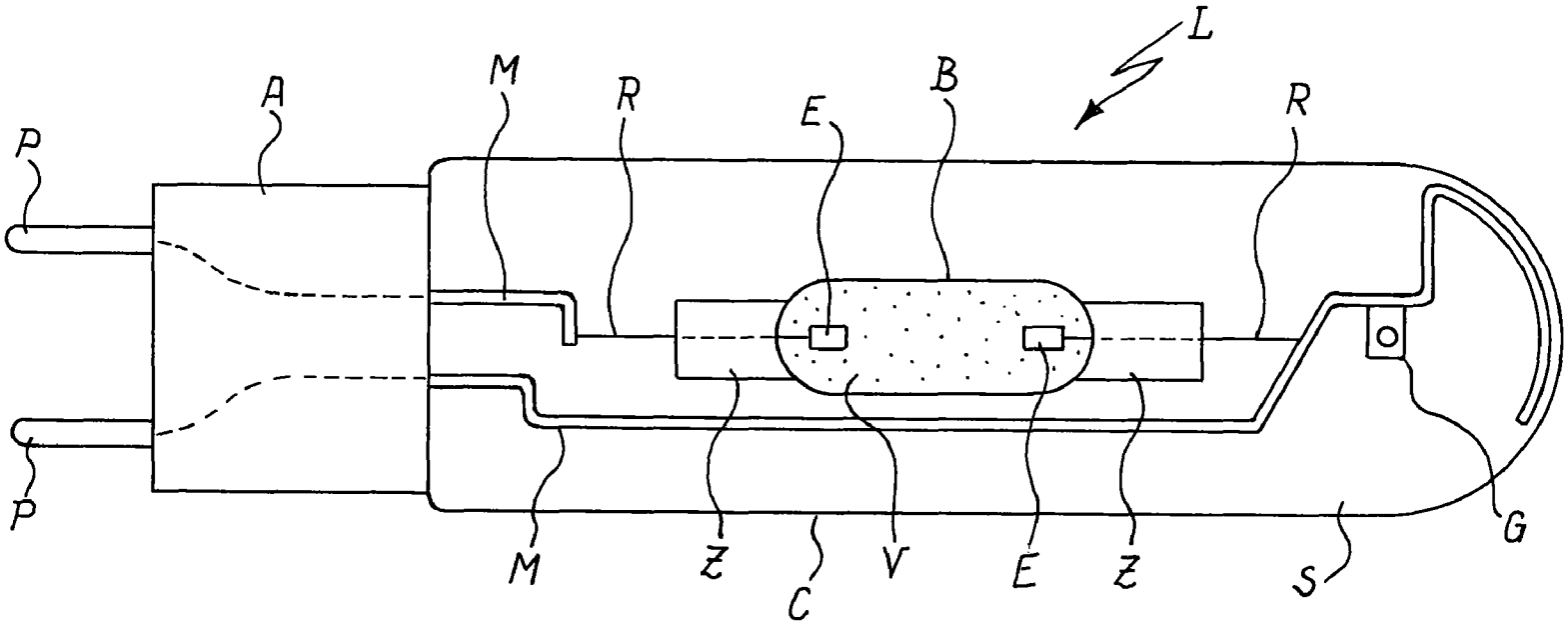
FIG. 1 is a schematic, sectional view of a generic high pressure discharge lamp.
Figure 12:
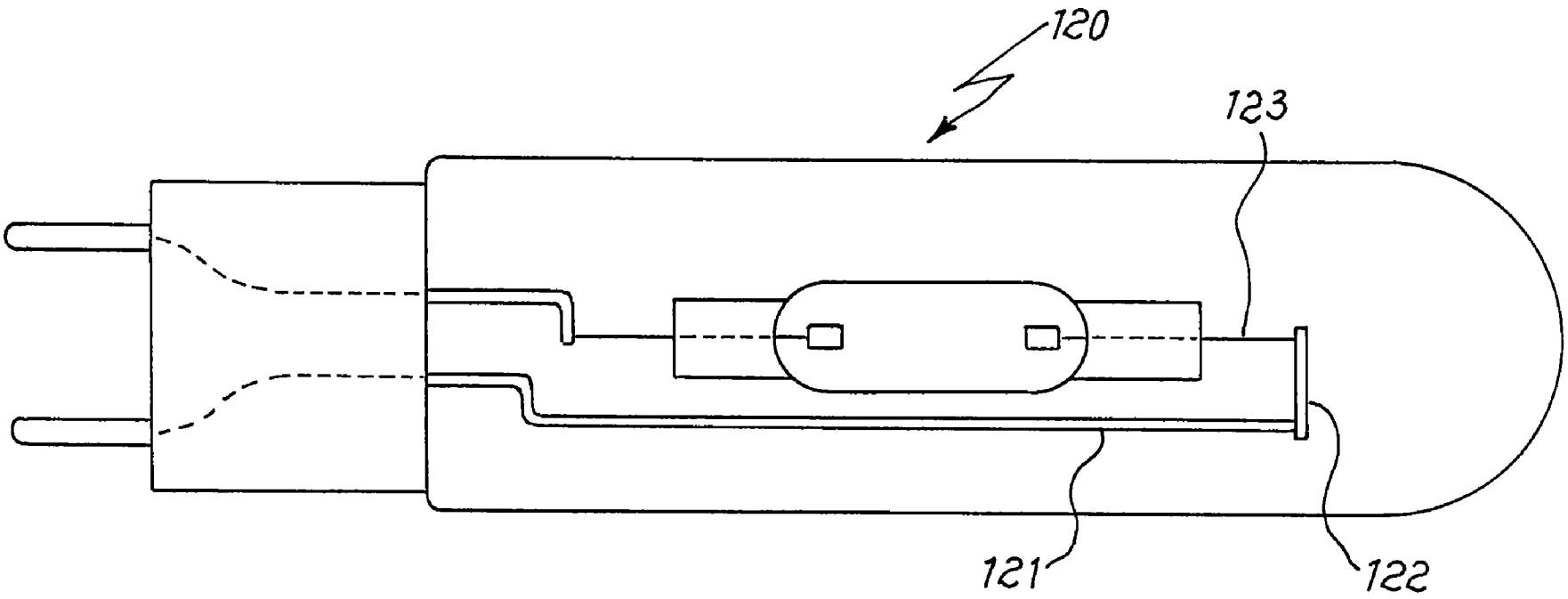
FIG. 12 is a cross-sectional view of a last embodiment of a lamp according to the present invention.

Finally, it is also possible to adopt a configuration (not shown in the drawings) that is a hybrid between the embodiments of FIGS. 9 and 11, in which the burner support is formed of a common metal wire in its initial part (the part closer to contacts P of FIG. 1) and by a getter device similar to the one of FIG. 11 for the remaining part. A particular form of realization of this last embodiment is shown in FIG. 12, and is particularly adapted for the production of lamps of smaller dimensions, that do not need the longer support of the burner contacting the end of the bulb to assure stiffness of the structure. Lamp 120 according to this last embodiment has the longer support of the burner that is made, for its main part 121, of a simple metallic wire and, for its terminal part, of the getter device 122, to which, in turn, is attached feedthrough 123 for sustaining and electrical feeding of the burner. Feedthrough 123 will be generally fixed to device 122 by welding, while device 122, in turn, may be fixed to part 121 mechanically, for instance by inserting the end portion of part 121 in a suitable bore or hollow of device 122 (the hollow may be of the kind described with reference to device 100), or as well by welding, e.g. spot welding.

The getter materials that can be used to produce devices 22, 22', 22", 52, 70, 92 and 111 are the ones described in the Background section, and in particular zirconium-aluminum alloys of U.S. Pat. No. 3,203,901, zirconium-cobalt-Rare Earths alloys of U.S. Pat. No. 5,961,750, yttrium and yttrium-based alloys of British Patent GB 1,248,184 or of International patent application publication WO 03/029502. It is also possible to use ZrYM alloys, where M is a metal chosen among aluminum, iron, chromium, manganese, vanadium or mixtures of these metals, described in International patent application PCT/IT2005/000673 of SAES Getters S.p.A.

We claim:

1. A high pressure discharge lamp comprising a bulb and, within the bulb, a burner, supports for the burner, the supports comprising metal parts, feedthroughs for feeding an electrical discharge in an atmosphere comprising a noble gas and metallic vapors in the burner, and a getter device, wherein the getter device is:

filiform, fixed to one of the metal parts supporting the burner, and in such a position to be parallel to the one metal part and essentially hidden to the burner by the one metal part; and wherein the getter device comprises a metal housing extended and open at the ends, inside which getter material in powder form is present.

2. The lamp according to claim 1, wherein the housing of the getter device comprises a material chosen among nickel, nickel-plated iron, stainless steel, niobium and tantalum.

3. The lamp according to claim 1, wherein the getter device comprises a getter material chosen among yttrium or yttrium-based alloys, zirconium-aluminum alloys, zirconium-cobalt-Rare Earths alloys and zirconium-yttrium-M alloys, where M is a metal chosen among aluminum, iron, chromium, manganese, vanadium or mixtures of these metals.

4. The lamp according to claim 1, wherein the bulb has an external diameter of about 2 cm or less and a length of less than 7 cm.

5. The lamp according to claim 1, wherein the getter device is fixed externally to one of the metal parts supporting the burner.

* * * * *